US006316989B1

(12) United States Patent
Kurooka

(10) Patent No.: US 6,316,989 B1
(45) Date of Patent: Nov. 13, 2001

(54) CASCADE CURRENT MILLER CIRCUIT

(75) Inventor: Kazuaki Kurooka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/543,419

(22) Filed: Apr. 5, 2000

(30) Foreign Application Priority Data

Nov. 24, 1999 (JP) ..... 11-333439

(51) Int. Cl.[7] ..... G05F 1/10
(52) U.S. Cl. ..... 327/538
(58) Field of Search ..... 323/312, 315, 323/316; 327/530, 538, 543

(56) References Cited

U.S. PATENT DOCUMENTS 5,045,773 * 9/1991 Westwick et al. ..... 323/316
5,457,426 10/1995 Brehmer ..... 330/253

FOREIGN PATENT DOCUMENTS 7-58557 3/1995 (JP) .

* cited by examiner

*Primary Examiner*—Jeffrey Zweizig
(74) *Attorney, Agent, or Firm*—Burns, Doane, Swecker & Mathis, LLP

(57) ABSTRACT

A cascade current Miller circuit includes a plurality of MOS transistors that form a current path (PASS32) through which there is flown a current 1/m times the current flowing through a first pair of cascade current Miller circuits structured by two MOS transistors. Further, there are provided a plurality of MOS transistors that form a current path (PASS33) through which there is flown a current 1/(m*3) times the current flowing through the first pair of cascade current Miller circuits. Further, there are provided a plurality of MOS transistors that form a current path (PASS34) through which there is flown a current 2/(m*3) times the current flowing through the first pair of cascade current Miller circuits.

4 Claims, 3 Drawing Sheets

P30:(PL32,PW32)
P31:(PL33,PW33)
P32:(PL32,PW32)
P33:(PL33,PW33)
P34:(PL32,PW32/m)
P35:(PL32,PW32*2/m)
P36:(PL32,PW32*4/m)
P37:(PL37,PW37)
P38:(PL38,PW38)

N30:(NL30,NW30)
N31:(NL31,NW31)
N32:(NL30,NW30/m)
N33:(NL31,NW31/m)
N34:(NL31,NW31/m)
N35:(NL31,NW31/m)
N36:(NL31,NW31/m)
N37:(NL31,NW31/(m*2))
N38:(NL30,NW30*n)
N39:(NL31,NW31*n)

P30:(PL32,PW32)
P31:(PL33,PW33)
P32:(PL32,PW32)
P33:(PL33,PW33)
P34:(PL32,PW32/m)
P35:(PL32,PW32*2/m)
P36:(PL32,PW32*4/m)
P37:(PL37,PW37)
P38:(PL38,PW38)

N30:(NL30,NW30)
N31:(NL31,NW31)
N32:(NL30,NW30/m)
N33:(NL31,NW31/m)
N34:(NL31,NW31/m)
N35:(NL31,NW31/m)
N36:(NL31,NW31/m)
N37:(NL31,NW31/(m*2))
N38:(NL30,NW30*n)
N39:(NL31,NW31*n)

FIG.2 CONVENTIONAL
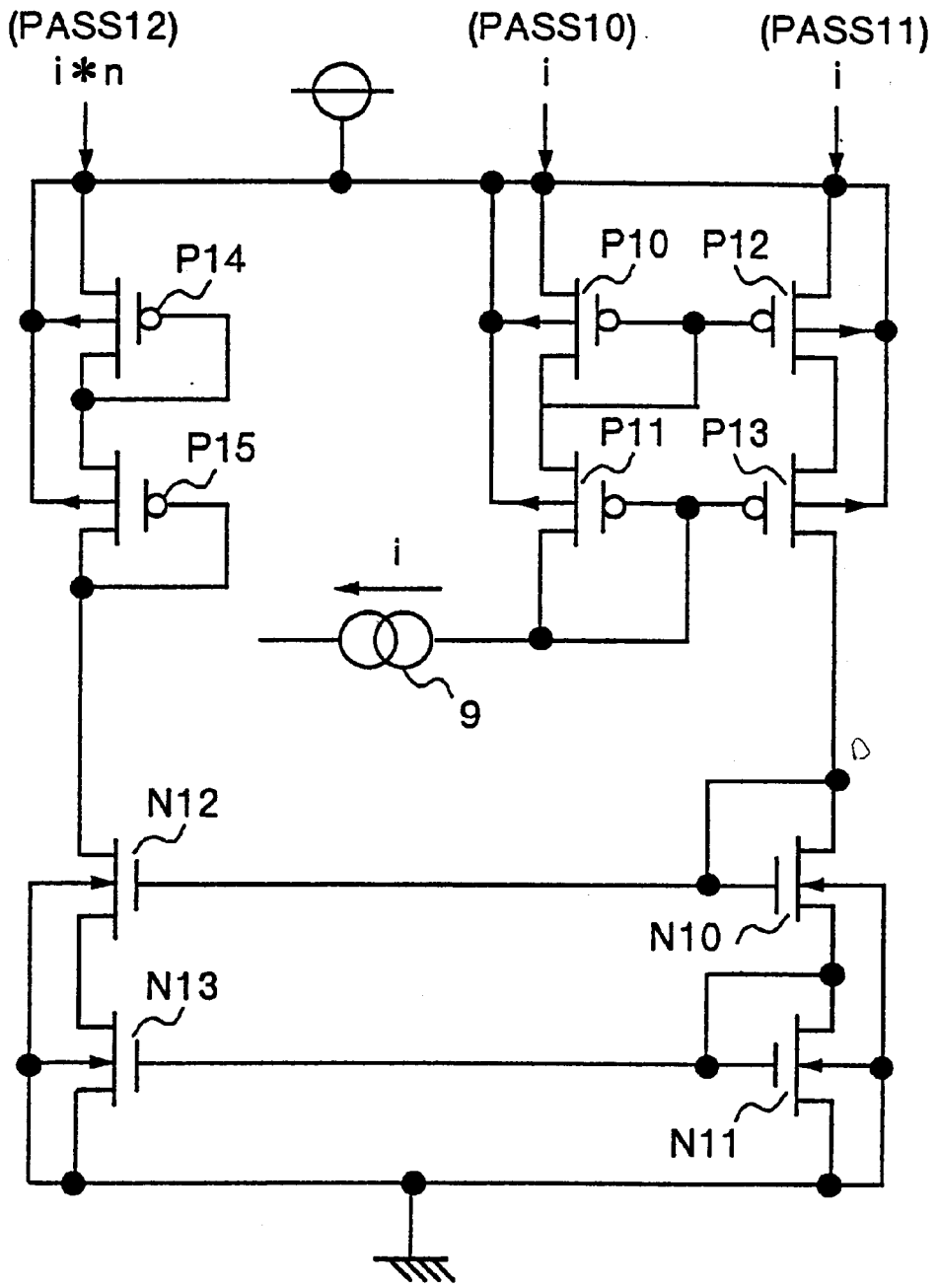
P10:(PL12,PW12)
P12:(PL12,PW12)
P14:(PL14,PW14)
P11:(PL13,PW13)
P13:(PL13,PW13)
P15:(PL15,PW15)
N10:(NL10,NW10)
N12:(NL10,NW10*n)
N11:(NL11,NW11)
N13:(NL11,NW11*n)

FIG.3
CONVENTIONAL
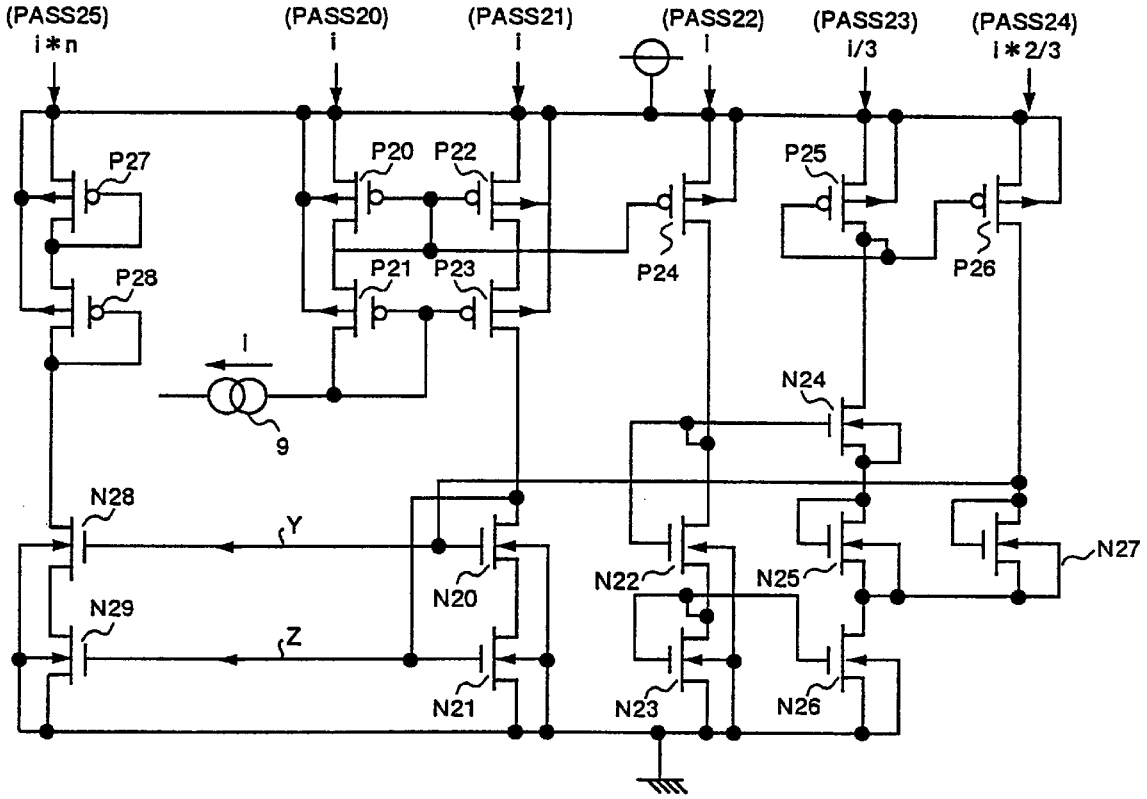
P20:(PL22,PW22) P21:(PL23,PW23), P22:(PL22,PW22)
P23:(PL23,PW23) P24:(PL22,PW22), P25:(PL22,PW22*2)
P26:(PL22,PW22*4) P27:(PL27,PW27), P28:(PL28,PW28)
N20:(NL20,NW20) N21:(NL21,NW21), N22:(NL20,NW20)
N23:(NL21,NW21) N24:(NL21,NW21), N25:(NL21,NW21)
N26:(NL21,NW21) N27:(NL21,NW21/2), N28:(NL20,NW20*n)
N29:(NL21,NW21*n)

CASCADE CURRENT MILLER CIRCUIT

FIELD OF THE INVENTION

The present invention relates to a cascade current Miller circuit that is advantageous for obtaining a voltage margin.

BACKGROUND OF THE INVENTION

FIG. 2 shows a conventional cascade current Miller circuit. The cascade current Miller circuit shown in FIG. 2 has a structure such that p-channel MOS transistors P10 and P12 forming a pair of current Miller circuits and p-channel MOS transistors P11 and P13 forming a pair of current Miller circuits are connected in cascade with each other. Of these pairs of current Miller circuits, the sources of the pair of current Miller circuits at the upper level (a first pair of current Miller circuits) are connected to a power supply voltage. Drain of the p-channel MOS transistor P11, that is the drain of one transistor of the two transistors forming the pair of current Miller circuits at the lower level (a second pair of current Miller circuits), is connected to a constant current source 9 that supply a constant current i.

Further, this cascade current Miller circuit has a structure such that n-channel MOS transistors N10 and N12 forming a pair of current Miller circuits and n-channel MOS transistors N11 and N13 forming a pair of current Miller circuits are connected in cascade with each other, to form a cascade Miller circuit. Drain of the n-channel MOS transistor N10, that is the drain of one transistor of the two transistors forming the pair of current Miller circuits at the upper level (a third pair of current Miller circuits), is connected to the drain of the p-channel MOS transistor P13. Thus the drain of the n-channel MOS transistor N10 is connected to the drain of other transistor of the second pair of current Miller circuits. The sources of the pair of current Miller circuits at the lower level (a fourth pair of current Miller circuits) are connected to the ground. Further, the drain of the n-channel MOS transistor N12, that is the drain of other transistor of the third pair of current Miller circuits, is connected to a drain of a p-channel MOS transistor P15. The p-channel MOS transistor P15 and a p-channel MOS transistor P14 are cascade-connected and their sources are connected to a power supply voltage.

In the above-described structure, a current path (PASS12) is formed by the p-channel MOS transistors P14 and P15 and the n-channel MOS transistors N12 and N13, and a current path (PASS10) is formed by the p-channel MOS transistors P10 and P11. Further, a current path (PASS11) is formed by the p-channel MOS transistors P12 and P13 and the n-channel MOS transistors N10 and N11. Reference symbols shown at the bottom of the drawing indicate channel lengths (hereinafter to be referred to as L-size) and channel widths (hereinafter to be referred to as W-size) of the respective MOS transistors. Sizes within each bracket indicate L-size and W-size respectively. It is assumed that there is a relationship of PL12>PL13 and NL11>NL10.

The operation of the cascade current Miller circuit will be explained below. At first, in FIG. 2, in the third and fourth current Miller circuits, there is a relationship that the W-size of the n-channel MOS transistor N12 is n times the W-size of the n-channel MOS transistor N10, and the W-size of the n-channel MOS transistor N13 is n times the W-size of the n-channel MOS transistor N11. Accordingly, the current flowing through the current path (PASS12) is expressed as i*n by the current Miller transfer of a current i from the current path (PASS11).

As shown in the drawing, a potential between the gate and the source ($V_{GS10}$) and a potential between the drain and the source ($V_{DS10}$) are equal, in the n-channel MOS transistor N10 that is the origin of the current Miller transfer. Similarly, in the n-channel MOS transistor N11, a potential between the gate and the source ($V_{GS11}$) and a potential between the drain and the source ($V_{DS11}$) are equal.

Accordingly, a potential between the gate and the source ($V_{GS13}$) has a relationship that $V_{GS13}=V_{GS11}=V_{DS11}$ in the n-channel MOS transistor N13 that is a current Miller transfer destination. Also, a potential between the gate and the source ($V_{GS12}$) has a relationship that $V_{GS12}=V_{G12}-V_{S12}=V_{GS11}+V_{GS10}-V_{DS13}$ in the n-channel MOS transistor N12. $V_{G12}$ and $V_{S12}$ respectively represent a gate potential and a source potential of the n-channel MOS transistor N12.

The following relationship is generally established in the saturation area of a MOS transistor.

$$V_{GS}=SQRT(\alpha IL/W)+V_{TH}$$

where $V_{GS}$, I, L, W and $\alpha$ respectively represent a voltage between the gate and the source, a drain current ($I_{DS}$), L-size and W-size, and a constant.

When $\Delta$ is substituted for SQRT ($\alpha$IL/W), the following 10 relationship is established.

$$\begin{aligned} V_{GS12} &= \Delta_{11} + V_{TH11} + \Delta_{10} + V_{TH10} - V_{DS13} \\ &= \Delta_{13} + V_{TH13} + \Delta_{12} + V_{TH12} - V_{DS13} \end{aligned}$$

$\Delta_{10}$, $\Delta_{11}$, $\Delta_{12}$ and $\Delta_{13}$ respectively represent the above $\Delta$ in the n-channel MOS transistors N10, N11, N12 and N13. $V_{TH10}$, $V_{TH11}$, $V_{TH12}$ and $V_{TH13}$ respectively represent the above $V_{TH}$ in the n-channel MOS transistors N10, N11, N12 and N13.

In order for the above-described third and fourth pairs of current Miller circuits to operate normally, it is necessary that each MOS transistor always operates in the saturation area. In order for the MOS transistor to operate in the saturation area, it is necessary to satisfy the relationship $V_{DS}\geqq V_{GS}-V_{TH}$. Further, as the relationship of $V_{GS}=V_{TH}+\Delta$ is established in the saturation area as described above, in other words it is necessary to satisfy the relationship $V_{DS}\geqq\Delta$.

On the other hand, it is necessary to satisfy the relationship $V_{DS12}\geqq V_{GS12}-V_{TH12}$ in the n-channel MOS transistor N12. This relationship can be modified as follows:

$$\begin{aligned} V_{D12} - V_{DS13} &\geq V_{G12} - V_{DS13} - V_{TH12} \\ &= V_{G10} - V_{DS13} - V_{TH12} \\ V_{D12} &\geq V_{GS11} + V_{GS10} - V_{TH12} \\ &= V_{TH11} + \Delta_{11} + V_{TH10} + \Delta_{10} - V_{TH12} \\ &= V_{TH13} + \Delta_{13} + V_{TH12} + \Delta_{12} - V_{TH12} \\ &= V_{TH13} + \Delta_{12} + \Delta_{13} \end{aligned}$$

In the above expressions, $V_{DS12}$, $V_{D12}$, $V_{G12}$, $V_{DS13}$ and $V_{G10}$ respectively represent a voltage between the drain and the source of the n-channel MOS transistor N12, a drain potential of the same MOS transistor, a gate potential of the same MOS transistor, a voltage between the drain and the source of the n-channel MOS transistor N13, and a gate potential of the n-channel MOS transistor N10.

In order for the n-channel MOS transistors N12 and N13 to be always in saturation areas, it is necessary to satisfy the relationship of $V_{DS12}\geqq\Delta_{12}$ and $V_{DS13}\geqq\Delta_{13}$, that is, $V_{D12}$ $(=V_{DS12}+V_{DS13})\geqq\Delta_{12}+\Delta_{13}$. However, it is necessary to meet the following relationship $V_{D12} \geqq V_{TH13}+\Delta_{12}+\Delta_{13}$ as described above. Therefore, this cascade current Miller circuit requires an additional voltage of $V_{TH13}$. Thus, there has been known "a cascade current Miller circuit advantageous for obtaining a voltage margin" that has reduced the additionally-used voltage of $V_{TH13}$.

FIG. 3 is a diagram which shows a conventional cascade current Miller circuit advantageous for obtaining a voltage margin. In FIG. 3, current paths (PASS25), (PASS20) and (PASS 21 ) and MOS transistors P20 to P23, P27, P28, N20, N21, N28 and N29 respectively correspond to (PASS12), (PASS10) and (PASS11) and the MOS transistors P10 to P13, P14, P15, N10, N11, N12 and N13 shown in FIG. 2.

The cascade current Miller circuit shown in FIG. 3 includes, in addition to the circuit structure shown in FIG. 2, a p-channel MOS transistor P24 forming a pair of current Miller circuits with the p-channel MOS transistor P20, p-channel MOS transistors P25 and P26 forming a pair of current Miller circuits, n-channel MOS transistors N22 and N24 forming a pair of current Miller circuits, n-channel MOS transistor N23 and N26 forming a pair of current Miller circuits, and n-channel MOS transistors N25 and N27 functioning as negative loads.

In the above-described structure, a current path (PASS22) is formed by the p-channel MOS transistor P24 and the n-channel MOS transistors N22 and N23, a current path (PASS23) is formed by the p-channel MOS transistor P25 and the n-channel MOS transistors N24, N25 and N26, and a current path (PASS24) is formed by the p-channel MOS transistor P26 and the n-channel MOS transistor N27.

The operation of the cascade current Miller circuit having the above-described structure advantageous for obtaining a voltage margin will be explained below. In FIG. 3, there is a relationship such that the W-size of the n-channel MOS transistor N28 is n times the W-size of the n-channel MOS transistor N20, and the W-size of the n-channel MOS transistor N29 is n times the W-size of the n-channel MOS transistor N21. Accordingly, the current flowing through the current path (PASS25) is expressed as i*n by the current Miller transfer of a current i from the current path (PASS21). Further, as the p-channel MOS transistors P20 and P22 have the same sizes, the current i flowing through the current path (PASS21) is the same as the current flowing through the current path (PASS20).

Since the p-channel MOS transistors P24 and P22 have the same sizes, the current flowing through the current path (PASS22) has the same magnitude i. Further, as the n-channel MOS transistors N23 and N26 have the same sizes, the current flowing through the n-channel MOS transistor N26 has the same magnitude i. Further, as the size ratio of the p-channel MOS transistors P25 to P26 is 1:2, a current of magnitude i/3 flows through the current path (PASS23) and a current of magnitude i*2/3 flows through the current path (PASS24).

The potential at the node Y shown in this figure will be obtained. A drain potential $V_{D22}$ of the n-channel MOS transistor N22 can be expressed as follows.

$$\begin{aligned} V_{D22} &= V_{DS22} + V_{DS23} \\ &= V_{GS22} + V_{GS23} \\ &= V_{TH22} + \Delta_{22} + V_{TH23} + \Delta_{23} \\ &= V_{TH20} + \Delta_{20} + V_{TH21} + \Delta_{21} \end{aligned}$$

In this case, $V_{TH20}$ and $\Delta_{20}$ represent a threshold level of the n-channel MOS transistor N20 and the above Δ, respectively, and $V_{TH21}$ and $\Delta_{21}$ represent a threshold level of the n-channel MOS transistor N21 and the above A , respectively.

Further, the drain voltage $V_{D22}$ coincides with the gate voltage $V_{G24}$ of n-channel MOS transistor N24, and the drain voltage $V_{D26}$ of the n-channel MOS transistor N26 can be expressed as $V_{G24}-V_{GS24}-V_{DS25}$. Therefore, the following relationship is established.

$$\begin{aligned} V_{D26} &= (V_{TH20} + \Delta_{20} + V_{TH21} + \Delta_{21}) - (V_{TH24} + \Delta_{24}) - (V_{TH25} + \Delta_{25}) \\ &= (V_{TH20} + \Delta_{20} + V_{TH21} + \Delta_{21}) - (V_{TH21} + \Delta_{21}/\sqrt{3}) - \\ &\quad (V_{TH21} + \Delta_{21}/\sqrt{3}) \end{aligned}$$

In this case, $V_{GS24}$ and $V_{DS25}$ represent a voltage between the gate and the source of the n-channel MOS transistor N24 and a voltage between the drain the source of the n-channel MOS transistor N25, respectively.

The potential of the node "Y" can be expressed as $V_{D26}+V_{GS27}$. Therefore, the following relationship is established as a result.

$$\begin{aligned} V_Y &= (V_{TH20} + \Delta_{20} + V_{TH21} + \Delta_{21}) - 2(V_{TH21} + \Delta_{21}/\sqrt{3}) + \\ &\quad (V_{TH21} + 2\Delta_{21}/\sqrt{3}) \\ &= V_{TH20} + \Delta_{20} + \Delta_{21}. \end{aligned}$$

In this case, $V_{DS22}$, $V_{GS22}$, $V_{TH22}$ and $\Delta_{22}$ represent a voltage between the drain and the source of the n-channel MOS transistor N22, a voltage between the gate and the source of the same MOS transistor, a threshold level of the same MOS transistor, and the above Δ, respectively. Further, $V_{DS23}$, $V_{GS23}$, $V_{TH23}$ and $\Delta_{23}$ represent a voltage between the drain and the source of the n-channel MOS transistor N23, a voltage between the gate and the source of the same MOS transistor, a threshold level of the same MOS transistor, and the above A, respectively.

On the other hand, in order for the n-channel MOS transistors N28 to operate in a saturation area, it is necessary to meet the relationship of $V_{DS28} \geqq V_{GS28}-V_{TH28}$. Therefore, the following relationship is established.

$$\begin{aligned} V_{D28} - V_{DS29} &\geq V_{G28} - V_{DS29} - V_{TH28} \\ &= V_Y - V_{DS29} - V_{TH28} \\ &= V_{TH20} + \Delta_{20} + \Delta_{21} - V_{DS29} - V_{TH20} \end{aligned}$$

In other words, the relationship of $V_{DS28} \geqq \Delta_{20}+\Delta_{21}$ is obtained. This corresponds to the theoretical expression of $V_{D12}>\Delta_{12}+\Delta_{13}$ obtained in the explanation of the normal cascade current Miller circuit.

Accordingly, this cascade current Miller circuit includes the above-described three current paths (PASS22), (PASS23) and (PASS24) for obtaining the above-described voltage Y, in addition to the above-described normal cascade current Miller circuit. As a result, it is possible to operate for an input of a large signal corresponding to the voltage of $V_{TH13}$ shown in FIG. 2.

In the above expressions, $V_{DS28}$, $V_{GS28}$, $V_{TH28}$, $V_{G28}$ and $V_{D28}$ represent a voltage between the drain and the source of the n-channel MOS transistor N28, a voltage between the gate and the source of the same MOS transistor, a threshold level of the same MOS transistor, a gate voltage and a drain voltage of the same MOS transistor, respectively. $V_{DS29}$ represents a voltage between the drain and the source of the n-channel MOS transistor N29.

Further, the n-channel MOS transistor N29 has the following relationship.

$$\begin{aligned} V_{DS29} &= V_Y - V_{GS28} \\ &= V_Y - V_{TH28} - \Delta_{28} \\ &= V_Y - V_{TH20} - \Delta_{20} \\ &= V_{TH20} + \Delta_{20} + \Delta_{21} - V_{TH20} - \Delta_{20} \\ &= \Delta_{21} = \Delta_{29} \end{aligned}$$

Thus, it is can be understood that the n-channel MOS transistor N29 is in the saturation area when $V_{DS29} \geqq \Delta_{29}$.

In the above-described cascade current Miller circuit advantageous for obtaining a voltage margin shown in FIG. 3, the magnitudes of the currents flowing through the three current paths (PASS22), (PASS23) and (PASS24) are assumed as i, i/3 and i*2/3 respectively. However, as the object of the circuit is to obtain the above-described voltage Y, the magnitudes of i, i/3 and i*2/3 are not necessarily required in the above current paths. Particularly, when the other circuits do not require a large current by using this cascade current Miller circuit, the magnitudes of these currents flowing through the three current paths (PASS22), (PASS23) and (PASS24) were not optimum. Therefore, these current levels have been a cause of interrupting energy saving of the circuit.

SUMMARY OF THE INVENTION

It is an object of the present invention to provide a cascade current Miller circuit advantageous for obtaining a voltage margin and having a low power consumption.

In order to achieve the object of the present invention, the cascade current Miller circuit according to the invention has such a configuration that the currents flowing through the three current paths (PASS22), (PASS23) and (PASS24) shown in FIG. 3 are decreased. Thus, the power consumption of the circuit as a whole can be reduced.

Further, the sizes of the first to third MOS transistors are set smaller than the size of each MOS transistor constituting the first pair of cascade current Miller circuits so that the currents flowing through the three current paths additionally provided for increasing the variable range of the output voltage are set smaller than the current flowing through the first cascade current Miller circuit. Therefore, it is possible to use a small current for obtaining a desired level of output voltage in a smaller layout area of the circuit.

Further, the sizes of the first to third MOS transistors are set smaller than the size of each MOS transistor constituting the second pair of cascade current Miller circuits so that the currents flowing through the three current paths additionally provided for increasing the variable range of the output voltage are set smaller than the current flowing through the first cascade current Miller circuit. Therefore, it is possible to use a small current for obtaining a desired level of output voltage in a smaller layout area of the circuit.

Other objects and features of this invention will become apparent from the following description with reference to the accompanying drawings.

BRIEF DESCRIPTION OF THE DRAWINGS

FIG. 2 shows one example of a conventional cascade current Miller circuit; and FIG. 3 shows one example of a conventional cascade current Miller circuit advantageous for obtaining a voltage margin.

DESCRIPTION OF THE PREFERRED EMBODIMENTS

Figure 1:
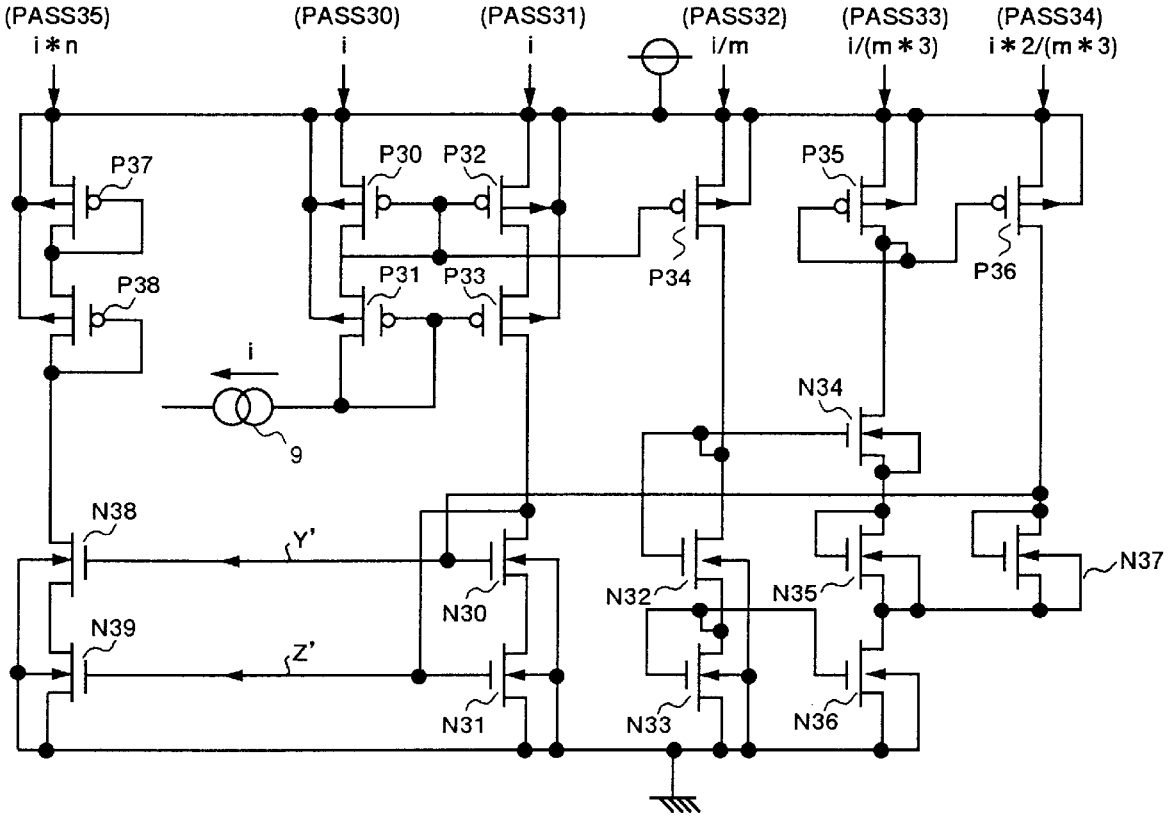
FIG. 1 shows a cascade current Miller circuit of one embodiment of the present invention.

There will be explained in detail below an embodiment of a cascade current Miller circuit relating to the present invention with reference to the drawings.

The cascade current Miller circuit of the present embodiment is characterized in that, in the conventional cascade current Miller circuit advantageous for obtaining a voltage margin shown in FIG. 3, the currents flowing through the three current paths (PASS22), (PASS23) and (PASS24) are decreased, thereby to reduce the power consumption of the circuit as a whole.

FIG. 1 shows the cascade current Miller circuit of this embodiment. The cascade current Miller circuit shown in FIG. 1 has the same structure as the cascade current Miller circuit shown in FIG. 3, except that the parts have been provided with different reference numbers. This cascade current Miller circuit is different from the conventional cascade current Miller circuit shown in FIG. 3 in that all the W-sizes of MOS transistors on current paths (PASS32), (PASS33) and (PASS34) respectively are 1/m of the W-sizes of the MOS transistors shown in FIG. 3, so that the magnitudes of all the currents are decreased by 1/m and the layout area is also reduced.

Particularly, the present embodiment is characterized in that a potential Y' (potential at the node Y') shown in FIG. 1 is the same as the potential Y shown in FIG. 3 regardless of the reduction in the W-sizes of the MOS transistors. This potential Y' will be explained below. First, a drain potential $V_{D32}$ of an n-channel MOS transistor N32 is expressed as follows.

$$\begin{aligned} V_{D32} &= V_{DS32} + V_{DS33} \\ &= V_{GS32} + V_{GS33} \\ &= V_{TH32} + \Delta_{32} + V_{TH33} + \Delta_{33} \\ &= V_{G34} \end{aligned}$$

Therefore, a drain potential $VD_{36}$ of an n-channel MOS transistor N36 can be expressed as follows.

$$\begin{aligned} V_{D36} &= V_{G34} - V_{GS34} - V_{GS35} \\ &= V_{TH32} + \Delta_{32} + V_{TH33} + \Delta_{33} - V_{TH34} - \Delta_{34} - V_{TH35} - \Delta_{35} \\ &= V_{TH32} + \Delta_{32} + V_{TH33} + \Delta_{33} - V_{TH33} - \Delta_{33}/\sqrt{3} - V_{TH33} - \\ &\quad \Delta_{33}/\sqrt{3} \end{aligned}$$

In view of the above fact, the potential Y' can be expressed as follows.

$$\begin{aligned} V_{Y'} &= V_{D36} + V_{GS37} = V_{D36} + V_{TH33} + 2\Delta_{33}/\sqrt{3} \\ &= V_{TH32} + \Delta_{32} + V_{TH33} + \Delta_{33} - V_{TH33} - \Delta_{33}/\sqrt{3} - V_{TH33} - \\ &\quad \Delta_{33}/\sqrt{3} + V_{TH33} + 2\Delta_{33}/\sqrt{3} \end{aligned}$$

-continued $$= V_{TH30} + \Delta_{30} + \Delta_{31}$$

This result corresponds to the above-described potential Y, that is, $V_Y = V_{TH20} + \Delta_{20} + \Delta_{21}$, and thus $V_{Y'}$ and $V_Y$ have same magnitude.

Further, a potential Z' (potential at the node Z') is expressed as $V_{Z'} = V_{GS31} = V_{TH31} + \Delta_{31}$ in FIG. 1. Also, a potential Z shown in FIG. 3 is expressed as $V_Z = V_{GS21} = V_{TH21} + \Delta_{21}$. Therefore, when the n-channel MOS transistors N21 and N31 have the same sizes, the potentials of these MOS transistors also coincide with each other.

As explained above, when the MOS transistors on the three current paths (PASS32), (PASS33) and (PASS34) have sizes 1/m times the sizes of the conventional MOS transistors on the three current paths (PASS22), (PASS23) and (PASS24) shown in FIG. 3 respectively, the power consumption of the circuit as a whole is also reduced to 1/m. Thus, it is also possible to reduce the size of the layout without changing the potentials Y' and Z' that are output.

According to the conventional cascade current Miller circuit shown in FIG. 3, the p-channel MOS transistors P22 and P24 have been set to have the same sizes in order to have the same current levels for the currents flowing through the current paths (PASS22) and (PASS21). Further, in order to set the threshold level $V_{TH}$ of the n-channel MOS transistor N21 equal to the threshold levels $V_{TH}$ of the n-channel MOS transistors N24, N25 and N27 respectively, the L-sizes NL21, NL24, NL25 and NL27 of these n-channel MOS transistors have been set equal to each other.

Further, in order to cancel the above-described Δ(=SQRT (αIL/W)), the ratio of the W-sizes of the p-channel MOS transistors P25 and P26 has been set as PW25:PW26=1:2, and the W-sizes of the n-channel MOS transistors N21 and N27 have been designed to have the relationship of NW27=NW21/2.

On the other hand, according to the cascade current Miller circuit shown in FIG. 1, in order to reduce the volume of the current flowing through the current path (PASS32), the W-sizes of the p-channel MOS transistors P32 and P34 are designed to have the relationship of PW34=PW32/m. Further, in order to set the current flowing through the n-channel MOS transistor N36 at an equal level to that of the current flowing through the n-channel MOS transistor N33, these MOS transistors are set to have the same sizes.

Further, in order to set the threshold level $V_{TH}$ of the n-channel MOS transistor N31 equal to the threshold levels $V_{TH}$ of the n-channel MOS transistors N34, N35 and N37 respectively, the L-sizes NL31, NL34, NL35 and NL37 of these n-channel MOS transistors are set equal to each other. Further, in order to cancel the above-described Δ(=SQRT (αIL/W)), the ratio of the W-sizes of the p-channel MOS transistors P35 and P36 is set as PW35:PW36=1:2, and the W-sizes of the p-channel MOS transistors N31 and N37 are designed to have the relationship of NW37=NW31/2.

According to the prior-art cascade current Miller circuit shown in FIG. 3, the total of the currents flowing through the three additionally-provided current paths (PASS22), (PASS23) and (PASS24) becomes 2i, which has no significant problem when the current i has a small current value of around a few μA. However, when the current value i becomes as large as tens of μA to hundreds of μA, the current of 2i cannot be disregarded.

On the other hand, as explained above, according to the cascade current Miller circuit relating to the present embodiment, the reduction in the current value i to 1/m without changing the potentials Y' and Z' that are important for the circuit, is effective in achieving energy saving. Particularly, as the sizes of the transistors become smaller, the layout area can also be made smaller, which makes it possible to improve the theoretical yield of wafers.

As explained above, according to the present invention, as the currents flowing through the three current paths additionally provided for increasing the variable range of the output voltage are set smaller than the current flowing through the first cascade current Miller circuit, it is possible to use a small current for obtaining a desired level of output voltage. The present invention has an effect that it is possible to reduce the power consumption of the circuit as a whole.

Further, the sizes of the first to third MOS transistors are set smaller than the size of each MOS transistor constituting the first pair of cascade current Miller circuits so that the currents flowing through the three current paths additionally provided for increasing the variable range of the output voltage are set smaller than the current flowing through the first cascade current Miller circuit. There is also an effect that a small current can be used to obtain a desired output voltage, which makes it possible to decrease the power consumption of the circuit as a whole and to make smaller the layout area of the circuit.

Further, the sizes of the first to third MOS transistors are set smaller than the size of each MOS transistor constituting the second pair of cascade current Miller circuits so that the currents flowing through the three current paths additionally provided for increasing the variable range of the output voltage are set smaller than the current flowing through the first cascade current Miller circuit. There is also an effect that a small current can be used to obtain a desired output voltage, which makes it possible to decrease the power consumption of the circuit as a whole and to make smaller the layout area of the circuit.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cascade current Miller circuit comprising:

a power source which generates a power source voltage;

a constant current source;

a first pair of cascade current Miller circuits having two sources and two drains, wherein both the sources are connected to said power source and one of the drains is connected to said constant current source;

a second pair of cascade current Miller circuits having two sources and two drains, wherein both sources are grounded and one of the drains is connected to the other drain of said first pair of cascade current Miller circuits;

a plurality of first MOS transistors connected in parallel to said first and second cascade current Miller circuits and that form a first current path through which a current having a magnitude 1/m times lower (where m denotes an integer greater than 1) than the current flowing through said first pair of cascade current Miller circuits;

a plurality of second MOS transistors connected in parallel to said first and second cascade current Miller circuits and that form a second current path through which a current having a magnitude 1/(m*3) times lower than the current flowing through said first pair of cascade current Miller circuits; and a plurality of third MOS transistors connected in parallel to said first and second cascade current Miller circuits and that form a third current path through which a current having a magnitude 2/(m*3) times lower than the current flowing through said first pair of cascade current Miller circuits, whereby a variable range of an output voltage is increased by a threshold level of predetermined MOS transistors that constitute the second pair of cascade current Miller circuits.

2. The cascade current Miller circuit according to claim 1, wherein at least one of said first MOS transistors has a size that is 1/m times the size of each MOS transistor constituting said first pair of cascade current Miller circuits, at least one of said second MOS transistors has a size that is 2/m times the size of each MOS transistor constituting said first pair of cascade current Miller circuits, and at least one of said third MOS transistors has a size that is 4/m times the size of each MOS transistor constituting said first pair of cascade current Miller circuits.

3. The cascade current Miller circuit according to claim 1, wherein at least one of said first MOS transistors has a size that is 1/m times the size of each MOS transistor constituting said second pair of cascade current Miller circuits, at least one of said second MOS transistors has a size that is 1/m times the size of each MOS transistor constituting said second pair of cascade current Miler circuits, and at least one of said third MOS transistors has a size that is 1/(m*2) times the size of each MOS transistor constituting said second pair of cascade current Miller circuits.

4. The cascade current Miller circuit according to claim 2, wherein at least one of said first MOS transistors has a size that is 1/m times the size of each MOs transistor constituting said second pair of cascade current miller circuits, at least one of said second MOS transistors has a size that is 1/m times the size of each MOS transistor constituting said second pair of cascade current Miller circuits, and at least one of said third MOS transistors has a size that is 1/(m*2) times the size of each MOS transistor constituting said second pair of cascade current Miller circuits.

* * * * *